United States Patent [19]

Rozengauz et al.

[11] 4,067,459

[45] Jan. 10, 1978

[54] MACHINE FOR SORTING FLAT OBJECTS

[76] Inventors: Solomon Monuilovich Rozengauz, ulitsa Marshala Birjuzova 43, kv. 142; Vasily Fedorovich Tikhonov, ulitsa Narodnogo Opolchenia, 20, kv. 170; Nikolai Kliontievich Mosolov, 3 Khoroshevskaya ulitsa, 5, korpus 1, kv. 50, all of Moscow, U.S.S.R.

[21] Appl. No.: 664,473

[22] Filed: Mar. 8, 1976

[30] Foreign Application Priority Data

Mar. 10, 1975 U.S.S.R. ..... 2111486
Nov. 26, 1975 U.S.S.R. ..... 2189517

[51] Int. Cl.[2] ..... B07C 3/10

[52] U.S. Cl. ..... 214/16.4 R; 209/111.7 R; 209/DIG. 1; 214/11 R

[58] Field of Search ..... 209/73, 74 R, 74 M, 209/110, 110.5, 111.7 R, 111.8, DIG. 1; 214/11 R, 11 C, 16.4 R, 16.4 A; 271/64; 53/173, 74; 270/58–60

[56] References Cited

U.S. PATENT DOCUMENTS

| | | | |
|---|---|---|---|
| 2,936,556 | 5/1960 | Gibson | 53/74 |
| 3,125,230 | 3/1964 | Edmunds et al. | 214/11 R |
| 3,302,804 | 2/1967 | Harris | 214/11 R X |
| 3,788,640 | 1/1974 | Stemmle | 271/173 |
| 3,791,515 | 2/1974 | Wood | 209/73 |
| 3,837,484 | 9/1974 | Ruckebier et al. | 209/74 M X |

*Primary Examiner*—Robert R. Reeves
*Assistant Examiner*—Fred A. Silverberg
*Attorney, Agent, or Firm*—Steinberg & Blake

[57] ABSTRACT

A sorting machine comprising several devices for introducing objects into the machine and a mechanism for conveying the objects to magazines mounted on the outer side of a cylindrical casing of the machine. The conveying mechanism is made in the form of a rotary drum of the squirrel cage type and a fixed cylindrical cam having cam surfaces which are coaxially mounted in the casing and are coaxially relative to each other. Rods are provided with object carriers which are movable along the rods, each object carrier being operatively connected to a respective cam surface of the cam for distributing the objects among the magazines. At the points of conjunctions of the cam surfaces there are provided switches which are actuated by a control device of the machine. During rotation of the driven drum, the object carriers which are guided by the cam surfaces of the cam are moved along the rods to distribute the objects among the magazines. The conveying mechanism also comprises containers and cams for automatic discharge of packs of sorted objects.

6 Claims, 10 Drawing Figures

MACHINE FOR SORTING FLAT OBJECTS

The invention relates to the automation of sorting of checks, bank accounts, invoices, orders, inventory cards, printed lists and the like.

The present invention may be the most advantageously used in the post branch where the problem of automatic sorting of letters is to be solved.

Common necessity in communication and information associated with an increase in the standards of living, growth of economic activities and elimination of illiteracy results in a considerable expansion of written correspondence all over the world which is also increased due to the demographic development.

In a majority of countries post exchange doubled for recent fifteen years. Thus the volume of written correspondence handled in the USA is about 80 mlrd. of mailed units per year, and this figure is of the order of 12 mlrd. in Great Britain, Japan and France.

The formation of large heavily populated towns leads to a concentration of post exchange in big centers.

All the above reasons result in the problem of searching for more advanced methods of handling letters in post office facilities, and in particular, the problem of the provision of automatic equipment for that purpose.

These problems are being solved by such large manufacturers as Telefunken and SEL (West Germany), Toshiba and NEC (Japan), Masson Scott Thrissel Engineering and Elliot (Great Britain) and Burroughs (USA).

Automatic machines for sorting letters carry out handling of a mass of correspondence in such a manner that the mass is sorted out in accordance with size, oriented with the address-bearing side of a letter to face a read out device in the position favourable for reading out zip code, displaced in a definite sequence in accordance with groups of post office zip codes and packaged in mailbags bearing address information.

Automatic machines for the sorting proper of letters in accordance with the groups of zip codes of post offices are the most complicated in the above-described range of machines.

In the development of such machines it is important to solve the following problems:

1. General layout of the machine from the viewpoint of convenience of operation and minimum surface area occupied by the machine.
2. Design of a mechanism of conveying letters to and sorting them among magazines.
3. Automatic discharge of packs of letters from the magazines.

During the development, the layout problem of the machine is solved basically in two ways: by providing machines with a linear arrangement of magazines and those with circular arrangement of magazines.

The machines with linear arrangement of magazines are made in the form of a parallelepipede, the magazines being arranged in a line in a horizontal plane in one or two rows and at several levels.

Automatic letter-sorting machines of this type also comprise a device for introduction letters into the machine having a mechanism for feeding a mass of letters provided with a mechanism for their separation from the mass one-by-one, a device for identification or reading out zip code of the letter and a device for controlling the mechanisms of the machine.

The mechanism for conveying and distributing letters among the magazines may comprise various containers, pairs of clamping belts or combinations of belts and guide surfaces or combination of belts and stationary guide rollers, and in addition, these mechanisms also have deflecting flaps for guiding a letter to a respective magazine.

Written correspondence is sorted out in these machines in the following manner.

A mass of letters is fed in containers or cases into introductory device of the machine, wherein the letters are separated one-by-one by means of a separating mechanism from the mass and passed in face of a read-out device which identifies the address of a magazine to which a given letter is to be conveyed. Then the letter is engaged by pairs of belts to be directed to a respective row and level of magazines and then to be disengaged from the belts into one or another magazine of the level by means of the deflecting flap. Sorted packs of letters are then manually unloaded from the magazines for further handling (packaging and provision of address label).

The problem of automatic unloading of letter packs from magazines was not solved in any known design of linear machines.

At present, it is the machines with the linear arrangement of magazines that are the most widely used, and all the above-mentioned manufacturers make automatic letter-sorting machines of this type.

At the same time, these machines have the following disadvantages:

1. Productive capacity of each such machine does not exceed 25,000 letters per hour due to a limited speed of conveyance of letters by means of flat belts.
2. Frequent damages to letters in the process of their conveyance inbetween the belts which is especially so in case of paper clips used for business correspondence, as well as with various insertions, bent flaps of envelopes and improper quality of envelope paper.
3. Large size of a belt drive due to the presence of pairs of clamping belts, hence large production area required for the machines.
4. Complicated design, maintenance and adjustment, as well as frequent replacements of worn belts.
5. High cost of belts which are manufactured of expensive antistatic materials.

Known in the art are also machines with the circular arrangement of magazines, such as an automatic letter-sorting machine made by Siemens (West Germany) (FRG Pat. No. 1,124,753, 43a 42/02, 1962).

The main part of said machine is a top rotary cylindrical crown consisting of radially located pockets for transporting a letter in a vertical position in each pocket. The bottom of a pocket is movable and openable for discharging the letter from the pocket into a magazine under gravity.

Mounted directly under the crown are receiving channels of troughs for changing the direction of movement of a letter in the horizontal and vertical planes. Mounted under the receiving channels there is a rotary cylindrical three-stage assembly of magazines for sorted letters. A trough for directing letters into a respective magazine when they fall under gravity is connected to each magazine to connect it to the receiving channels.

Besides, this machine comprises a device for introduction letters into the machine having a mechanism for feeding a mass of letters provided with a mechanism for separation of letters one-by-one from the mass, a device for identification or reducing-out of zip code of the letters and a device for controlling the mechanisms of the machine.

The machine functions in the following manner.

The cylindrical assembly of magazines and the cylindrical crown are rotated in the opposite directions. Letters are fed to the top portion of the machine and are introduced one-by-one into the pockets of the cylindrical crown, the letter being placed vertically in the pocket.

Prior to the feeding into pockets, the letters pass in face of an identification device for definition of the address of magazine to which a letter is to be delivered.

The bottom of each pocket is operatively connected to a device for controlling the machine and is open when the pocket reaches a respective magazine.

When the bottom is open, the letter is fed from the pocket into the magazine along a curved trough.

During the movement along the trough, the letter is turned at 90° relative to the plane of fall so as to be placed in the magazine in a horizontal plane.

The use of guide troughs is a considerable disadvantage of the machine since they materially reduce reliability of the system of conveyance and distribution of letters and impair quality of arrangement of letters in the magazines. Thus, stoppages and frequent damages to letters take place, especially when the letters have some inserted matter, or are deformed (bent, damaged) or wet.

Another disadvantage of this machine consists in rotation of the assembly of magazines which makes impossible for an operator to unload the magazines in the process of sorting of letters.

In addition, the disadvantage of the machine resides in the absence of automatic unloading of a pack of letters from a magazine.

The provision of guide troughs considerably increases the size of the machine.

This construction of the machine does not ensure sufficiently high throughput capacity.

A machine for sorting letters having circular arrangement of magazines is disclosed in U.S. Pat. No. 3,125,230, Cl. 21411, 1964.

The machine comprises a cylindrical casing and magazines for sorted letters which are located at several levels on the outer side of the casing and spaced along a circuference thereof. A mechanism for conveying and distributing objects among the magazines comprises a rotary drum which is mounted by means of rollers in a circular guide.

Magazines are provided with throughs for guiding letters therein.

Each vertical row of magazines has an unloading station mounted between the rotary drum and the troughs which consists of a number of deflecting flaps equal to the number of magazines in the vertical row.

The machine also comprises a device for introduction objects into the machine which is provided with a mechanism for feeding a mass of flat objects having a mechanism for separating objects one-by-one from the mass, a device for identification of a distinctive feature of an object and a device for controlling all mechanisms of the machine.

The objects sorted out one-by-one pass by the identification device and, after identification of the address of the magazine to which a given letter is to be fed, the letter is fed to the inner surface of the rotary drum. The letter is urged against the drum surface under the action of centrifugal force and is transferred by the drum to the unloading station of a respective vertical row of magazines.

Then the letter is separated from the drum by means of a flap and is transferred into the trough of a respective magazine so that the object is fed under gravity along the trough into the magazine.

The use of centrifugal force for letter transfer is not reliable because the letters have different weight, size and surface properties (e.g. post cards having glossy surface cannot adher to the inner surface of the drum) so that the transfer cannot be carried out with a given spacing and at a constant speed.

In addition, this machine has all disadvantages inherent in the machines using letter transfer under gravity as it was said in analyzing the machine manufactured by the Siemens company as disclosed in FRG Pat. No. 1,124,753, 43a42/02, 1962.

A machine for sorting letters having circular arrangement of magazines is disclosed in U.S. Pat. No. 2,936,556, Cl. 53-74, 1960. The machine comprises a cylindrical casing having several levels of magazines mounted on the outer side thereof.

Distributing troughs are mounted over the magazines on a surface in the shape of a truncated cone, and the troughs comprise branched channels having switches at the branching points, the troughs having one channel at the top portion which is repeatedly branched into pairs of branches so as to terminate in ten and more magazines in the bottom portion. Over the troughs there is mounted a rotary crown with pockets, and a device for introduction letters into the machine is mounted over the crown and has a mechanism for feeding a mass of letters provided with a mechanism for separating objects one-by-one from the mass and with a device for identification of a distinctive feature of an object, as well as with a device for controlling all mechanisms of the machine.

Letters pass one-by-one by the device for identification of their distinctive features to identify the address of a magazine and are then fed into a pocket of the rotary crown.

From the pocket, the letters are fed to a trough and therefrom, after actuation of respective switches in the channels, they are fed to a respective magazine.

All above-mentioned disadvantages associated with the letter transfer under gravity become more pronounced in this machine by the fact that the letters moving under gravity in the troughs are deflected by switches for being selectively fed into a respective channel. This increases the likelyhood of damages to the letters and occurrence of congestions.

In addition, the system of distributing troughs in the form of branching channels results in increased size of the machine.

It is obvious that the productive capacity of such a machine cannot be sufficiently high due to the system for distributing letters among magazines.

The above review of the existing designs of automatic letter-sorting machines makes it possible to summarize their disadvantages which result in:

frequent damages to letters during their transfer inbetween flat belts or during the feeding along troughs;

low productive capacity of the machines which is limited by the letter transfer inbetween flat belts or by feeding under gravity;

large size of the machines resulting from large size of belt drives and guide troughs;

absence of automatic unloading of letter magazines.

It is an object of the invention to improve the quality of sorting of flat objects with complete automation of the sorting process.

Another object of the invention is to provide a machine for sorting flat objects which enables an increase in the productive capacity of the sorting process.

Still another object of the invention is to provide a machine for sorting flat objects which enables an improved reliability in operation.

And finally, it is an object of the invention to provide a machine for sorting flat objects in which the magazines for sorted packs of objects are unloaded automatically.

These and other objects are accomplished by that in a machine for sorting flat objects from a mass of objects comprising a cylindrical casing having magazines for sorted packs of objects provided at several circular levels on the outer side of the casing, a device for introduction objects into the machine having a mechanism for feeding a mass of flat objects provided with a mechanism for separating objects one-by-one from the mass and a device for identification of a distinctive feature of each object, and a device for controlling all said mechanisms of the machine, wherein, according to the invention, the mechanism for conveying letters and distributing them among magazines comprises a rotary drum of the squirrel cage type and a fixed cylindrical cam which are coaxially mounted in the casing, the cam having cam surfaces and being arranged within the drum, and object carriers each being mounted on a rod of the driven drum for moving therealong and operatively connected to a respective cam surface of the cam for distributing the objects among magazines during continuous rotation of the drum, the conjugating portions of the cam surfaces of the cam being provided with switches actuated by the control device of the machine.

This design of the mechanism for conveying the objects and distributing them among magazines eliminates the engagement of an object being sorted with actuating members of the machine, enables high productive capacity of the sorting process and small size.

A very important development in this machine is the automatic unloading of magazins for sorted objects.

For that purpose, the mechanism for conveying the objects and distributing them among magazines comprises object removing means for unloading and conveying packs of objects and cams, each object removing means and each cam being mounted to one of the spokes of the squirrel cage for displacement therealong and is connected to a respective cam surface of the cylindrical cam, and the bottom of each magazine comprises a container which is radially movable in the casing of the machine upon cooperation with the cams so that in one position of the movable container the object removing means engages a pack of objects for delivering it from the machine.

Thus an automatic unloading of packs of sorted objects from magazines is ensured, the mechanisms for unloading packs of sorted objects being made using the assemblies of the mechanism for conveying objects and distributing them among magazines of the rotary drum of the squirrel cage type, as well as a system of distributing channels, portions movable along the drum rod and rollers movable axially of the channels.

In order to improve the productive capacity of the machine which is limited by the time of actuation of driven mechanisms for distributing letters among magazines, the cam surfaces of the stationary cylindrical cam are made in the form of parallel systems of distributing channels whose number is equal to the number of the devices for introduction objects into the machine, each system of distributing channels comprising a number of parallel channels one of which is closed along the circumference of the cylinder, the other channels communicating with one another and with the closed channel and being arranged on either side of this channel in parallel with the levels of magazines with a spacing corresponding to the spacing between the levels, the number of channels arranged at each level of magazines being equal to the number of systems of distributing channels.

The provision of at least two parallel systems of distributing channels with the provision of driven mechanism for distributing letters among magazines for each of them also in parallel fashion makes it possible to have a flow of letters passing through each system which is twice as smaller, and the whole stream of letters from several systems may be directed to each magazine, the interval between the cycles of admission of letters to a magazine from the two systems of distributing channels being two times shorter than the actuation cycle of the driven mechanism so that throughput capacity of the machine is doubled.

It is important that the machine have minimum possible number of object carriers and devices for unloading packs of sorted letters.

For that purpose the object carrier, object removing means and cam are mounted on a rod each by means of an individual sleeve rigidly connected to a roller received in the cam channel.

This facility provides for independent displacement of the object carrier, object removing means and cam and for minimum number of these members.

Thus, if the number of object carriers in the above-described known designs of the machines was 2–3 times larger than the number of magazines, the number of object carriers in the machine according to the invention is 8–10 times smaller than the number of magazines.

In order to provide for simplicity and reliability of the design, each object carrier comprises a C-shaped bracket and has lower arms for holding an object against the branches of the bracket, and each object removing means also comprises a C-shaped bracket and has fixed stops for removing objects from the magazine platform and for holding them against the branches of the bracket. Object carriers having different systems of distributing channels are spaced apart at an equal distance from the magazines of each level.

This design of the object carriers and object removing means features an extreme simplicity, reliability and absence of expensive materials, and it enables complete preservation of a sorted object against eventual damages.

In order to provide for minimum number of driven mechanisms, each magazine is provided with a driven stop mounted for cooperation with the lower arms of the object carriers, and for each system of distributing channels there is provided one drive mechanism connected to all drive stops of the magazines which are mounted along the generatrix line of the cylindrical casing of the machine.

This facility results in the fact, that even with the provision of several systems of distributing channels, the number of driven mechanisms for distributing letters among the magazines is several times smaller than the number of magazines.

Other objects and advantages of the present invention will be better understood from the following detailed description of specific embodiments thereof with reference to the accompanying drawings, in which.

Figure 8:
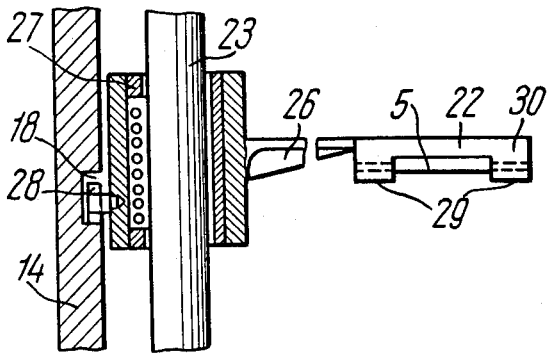
Figure 9:
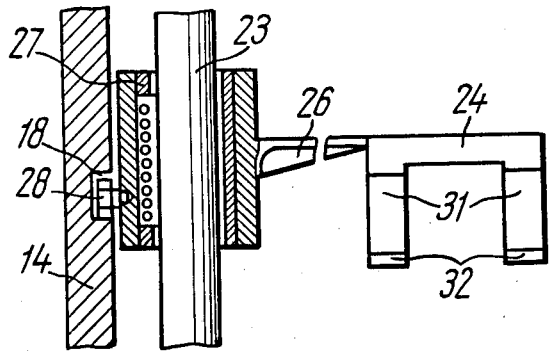

FIG. *7a* and *b* shows the arrangement of object carriers in relation to the distributing channels and a level of magazines;

FIG. 8 shows an object carrier for conveying flat objects to magazines;

FIG. 9 shows a object removing means for unloading and conveying packs of objects.

The machine for sorting flat objects comprises a cylindrical casing 1 (FIG. 1) which is externally provided with circumferentially spaced magazines 2 arranged at different levels.

Two devices 3 and 4 (FIGS. 1, 2 and 3) for introduction objects 5 from a mass of objects 6 into the machine are mounted adjacent to the casing 1. Each of the devices 3 and 4 comprises two mechanisms 7 and 8 for feeding flat objects 5 one-by-one from the mass 6 into the machine. For that purpose, each mechanism 7 and 8 is provided with a mechanism 9 and 10, respectively, for separating the objects 5.

The mechanism 9, 10 for separating the objects may comprise, e.g. a known machine for vacuum separation of flat objects from a pack (not shown) which consists of a vacuum chamber mounted over a pack of the objects being sorted and a flat perforated belt moving between the chamber and the pack of objects. Thus, at the moment when the perforation of the belt is in register with the vacuum chamber, a flat object is attracted to the moving belt and is separated from the pack with a spacing equal to the space between the perforations.

The devices 3 and 4 for feeding the objects 5 into the machine each comprises devices 11 and 12, respectively, for identification of a characteristic feature of each object 5.

Such device may be built around a principle of known devices for automatic identification of image comprising an optical device projecting an image to a screen of an electron ray tube or to a photodiode matrix and electronic logics for analyzing the displayed information.

Since each device 3, 4 for introduction the objects 5 into the machine comprises in this case two separating mechanisms 9 and 10, each of the latter may have the productive capacity which is half the total productive capacity of each of the devices 3, 4 for introduction the objects 5 into the machine.

Figure 3:
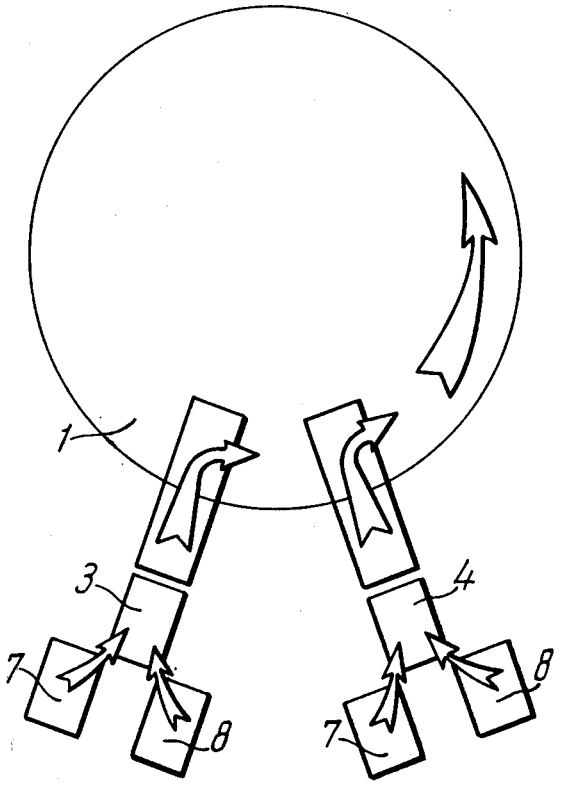
FIG. 3 shows a diagram of the introduction and distribution of letters among magazines.

The total productive capacity of the machine is, in turn, twice as great (in accordance with the number of the devices 3 and 4 for introduction the objects 5 into the machine) as the productive capacity of one device 3 or 4 for introduction the objects into the machine (FIG. 3).

Thus, if the productive capacity of each separating mechanism 9 or 10 is 25 thousand flat objects per hour, the total productive capacity of the machine is 100 thousand objects per hour.

The mechanism for conveying the objects 5 and distributing them among the magazines 2 (FIGS. 4, 5 and 6) comprises a rotary drum 13 of the squirrel cage type and a stationary cylindrical cam 14 which are coaxially mounted in the casing 1, the cam being arranged inside the drum 13.

Figure 4:
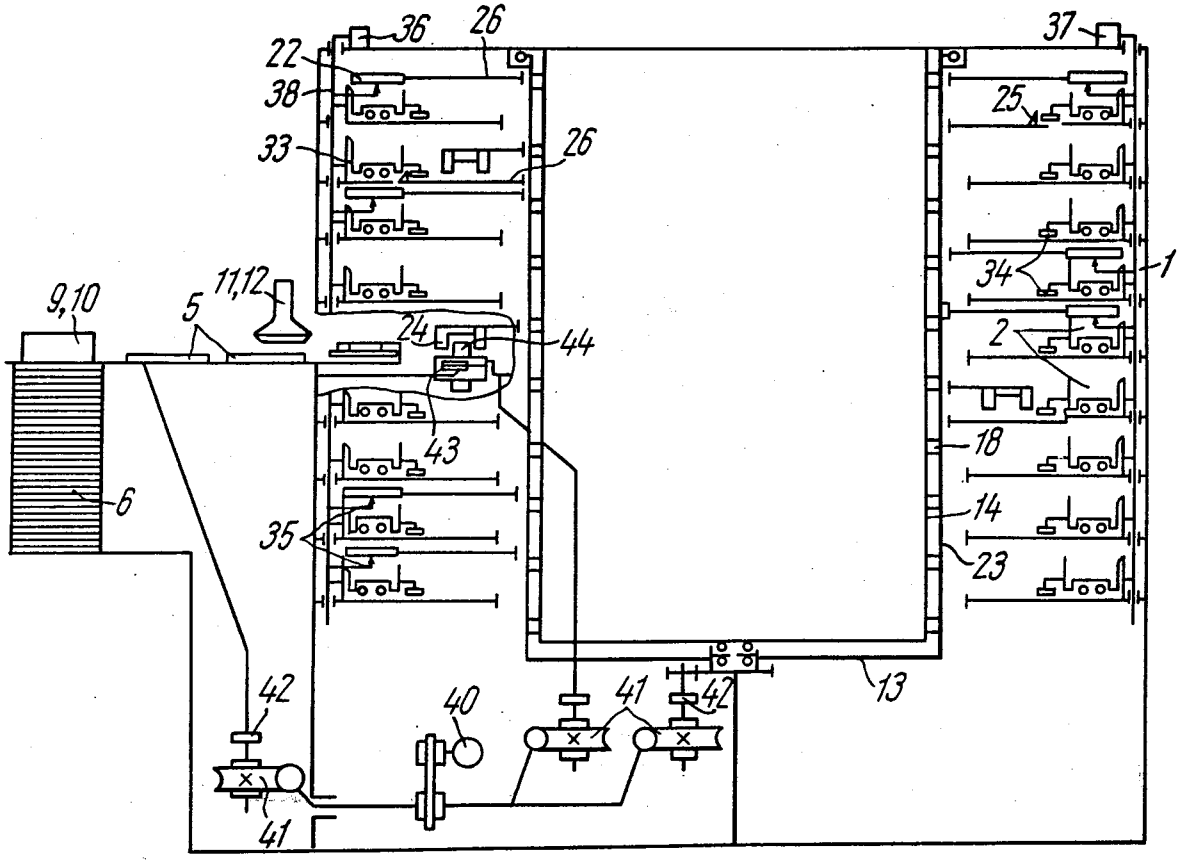
FIG. 4 shows a longitudinal section of the machine for sorting flat objects according to the invention.
Figure 5:
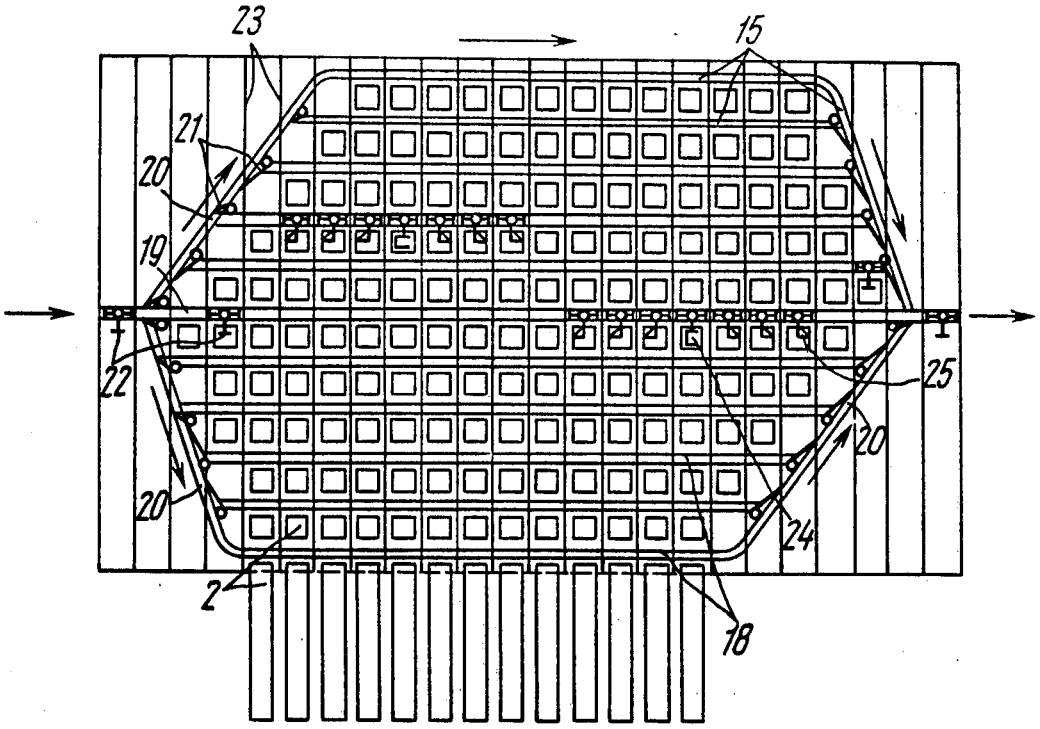
FIG. 5 is a developed view of the fixed cylindrical cam with a single system of distributing channels, switches and magazines.
Figure 6:
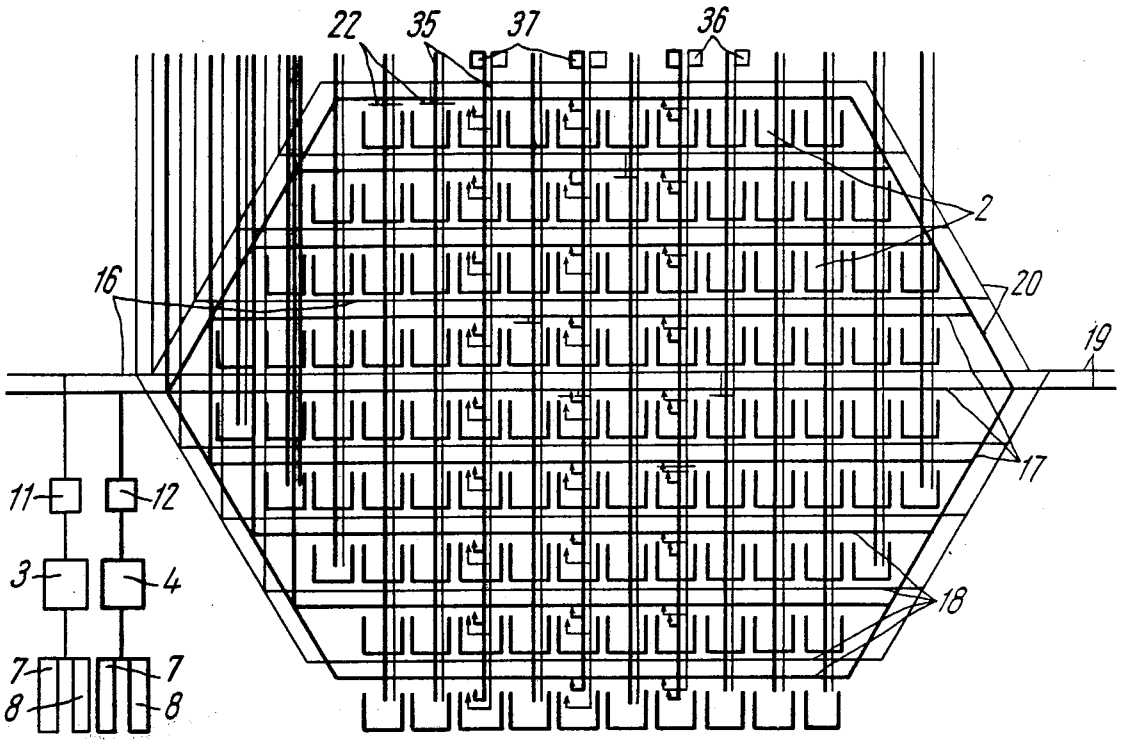
FIG. 6 shows an embodiment of the fixed cylindrical cam having two systems of distributing channels.
Figure 7B:
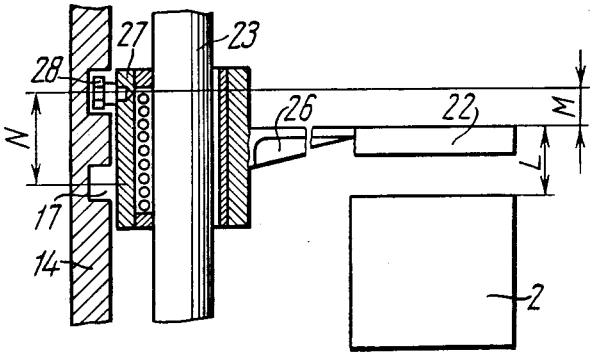
Figure 7A:
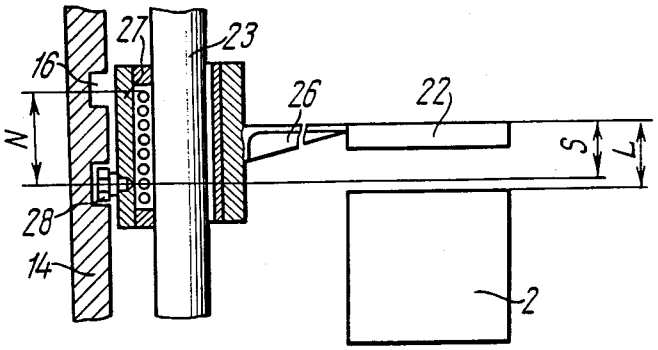

The stationary cylindrical cam 14 has cam surfaces 15 (FIGS. 1, 4) forming two systems 16 and 17 of parallel distributing channels 18 (FIGS. 5 and 6). The number of systems is equal, in this case to the number of devices 3 and 4 for introduction the objects 5 into the machine. In FIG. 6 the system 16 is shown with a thick line and the system 17 is shown with a thin line. The number of systems of distributing channels may be greater depending on the desired productive capacity of the machine.

Each system 16, 17 comprises a number of parallel channels 18 one of which, a channel 19, is closed along the circumference of the cam 14 (FIG. 5). The other channels communicate with one another and with the closed channel 19 by means of channels 20 inclined to the vertical axis of the machine.

The channels 18 are arranged on either side of the channels 19 in parallel with the levels of the magazines 2 with a spacing equal to the spacing of the levels. The number of the channels 18 arranged at each level of the magazines 2 is equal to the number of systems of the distributing channels. The channels 18, 19 and 20 are provided with switches at the conjunction points, and the switches are actuated by a control device of the machine (not shown).

Figure 1:
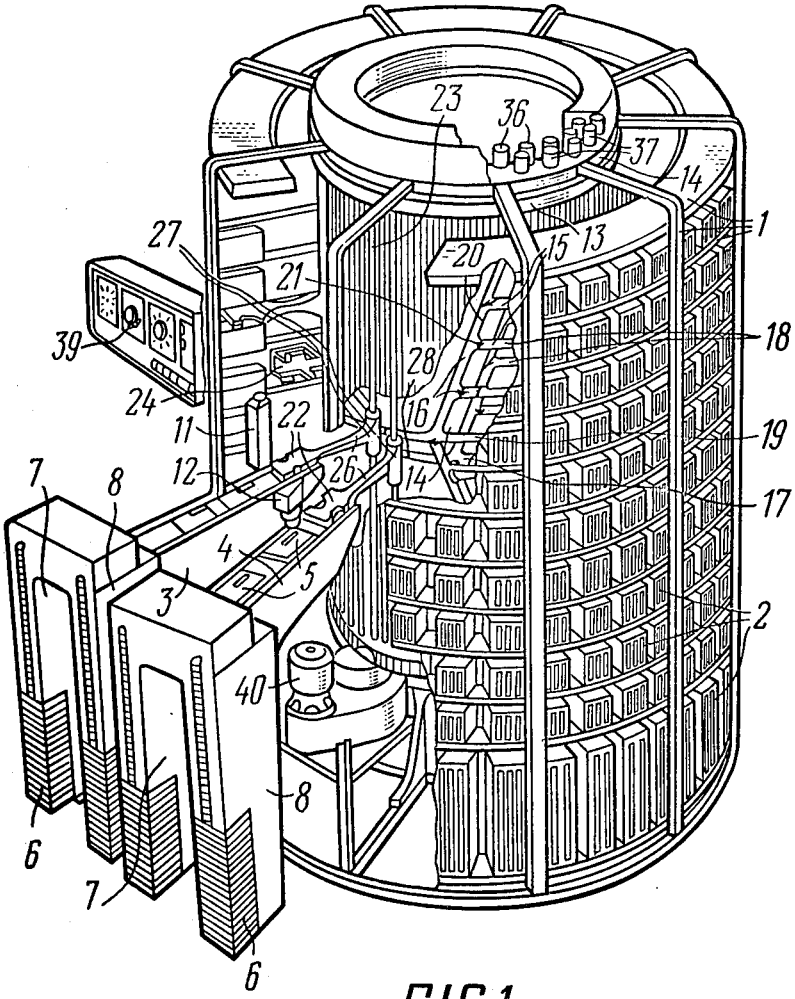
FIG. 1 is a general view of the machine for sorting flat objects from a mass of objects according to the invention.
Figure 2:
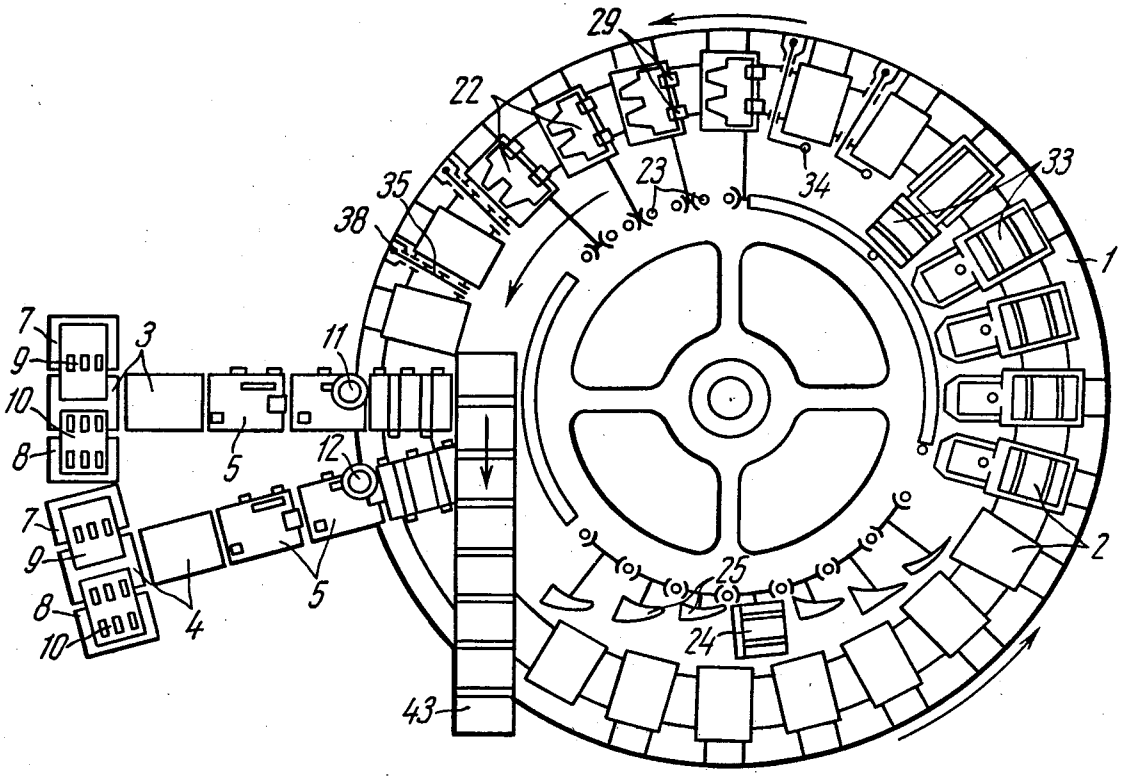
FIG. 2 is a plan view of the machine shown in FIG. 1.

The mechanism for conveying the objects 5 and distributing them among magazines also comprises object carriers 22 each being mounted on one of rods 23 of the squirrel cage drum (FIGS. 1, 2).

Since the channels 18 of the distributing systems 16 and 17 are arranged above one another at a distance "N" (FIG. *7a* and *7b*) and since, in order to provide identical conditions for distribution of the objects 5 among the magazines 2, the distance "L" of the objects 5 from the level of the magazines 2 should be the same in every case (FIGS. *7a* and *7b*), the object carriers 22 are mounted on the rods 23 of the squirrel cage drum at different distances "S" and "M" from their distributing channel 18 (FIGS. *7a* and *7b*).

Furthermore, the mechanism for conveying the objects 5 and distributing them among the magazines comprises object removing means 24 and cam 25 for unloading packs of the sorted objects 5 from the magazines 2 and for further conveyance of the objects 5 for their delivery from the machine.

The object carrier 22, object removing means 24 and cam 25 are mounted each on an individual arm 26 which is rigidly connected to an individual portion 27 (FIGS. 8 and 9).

The portion is mounted on the rod 23 of the drum 13 for axial movement therealong and is rigidly connected to a inner cam follower portion 28 mounted in a respective channel 18 (FIGS. 8 and 9).

The object carrier 22 comprises a C-shaped bracket (FIG. 8) and has lower arms 29 for holding the objects 5 against branches 30 of the bracket.

The object removing means 24 is made in the form of a C-shaped bracket (FIG. 9) and has fixed stops 31 for removing the object 5 from the magazine 2 and for holding it against branches 32 of the bracket.

Two groups of the cams 25 (FIG. 2) corresponding to each object removing means 24 are arranged in the following manner relative to the object removing means: one group of the cams 25 which consists, e.g. of three cams is mounted on the spokes 23 in front of the object removing means 24, and the other group of the cams 25, which also consists of three cams, is mounted on the rods 23 behind the object removing means 24.

Inner cams surfaces of the group of the cams 25 mounted in front of the object removing means 24, which are closer to the central part of the machine, are profiled in the form of an arc enclosing the cam surfaces of all cams with a radius from the center of the machine which is greater at the beginning of the group of cams and smaller at the end of the group in cams in the direction of cams movement.

Outer cam surfaces of the group of the cams 25 mounted behind the object removing means 24, which are closer to the peripheral surface of the machine, are profiled in the form of an arc enclosing the cam surfaces of all the cams with a radius from the center of the machine which is smaller at the beginning of the group of cams and greater at the end of the group of cams in the direction of the cams movement.

One or two groups of the containers 24 with the cams 25 may be mounted in the machine depending on the desired productive capacity of unloading the packs of sorted objects.

The bottom of each magazine 2 comprises a container 33 which is radially movable in the casing of the machine in the direction toward the central axis of the machine (FIGS. 2 and 4). The movable container 33 is rigidly connected to a roller 34.

In addition, the magazine 2 is provided with a driven stop 35 (FIGS. 2, 4 and 6) for removing the object 5 from the object carrier 22 and for placing the object into the magazine 2.

Each driven stop 35 is connected to driving mechanisms 36 and 37 (each system 16, 17 comprises an individual driving mechanism).

Each driving mechanism 36 and 37 comprises, e.g. an electromagnet (not shown) having an armature which is rigidly connected to a rod 38 (FIGS. 4 and 6) for connecting the electromagnet to the driven stops 35 of the magazines 2. Each driving mechanism 36, 37 controls the stops 35 of all magazines 2 mounted along the generatrix line of the cylindrical casing 1 of the machine for each system 16, 17 of the distributing channels 18.

Since, at each given moment, there is only one object 5 on a vertical line defined by the spoke 23 of the drum 13 which coincides with the vertical row of the magazines 2, it is sufficient, in this case, to have one driving mechanism 36, 37, respectively, for each system 16, 17 as shown in FIG. 6.

The machine for sorting flat objects 5 into the magazines 2 also comprises a general control mechanism 39 (FIG. 1) provided with a computer for sorting the objects in accordance with a programme (not shown).

In addition, the machine comprises a mechanical drive for rotating the drum 13, the mechanisms for separating the objects 5 and the mechanism for unloading the magazines 2. The mechanical drive comprises an electric motor 40 (FIG. 4), reducing gears 41 and clutches 42 connecting the shaft of the electric motor 40 to the shafts of the respective mechanisms of the machine. And finally, the machine comprises a linear conveyor 43 with stops 44 for delivery of packs of the sorted objects 5 from the machine which are mounted at the level of the closed channel 19 tangentially to the generatrix line of the cylindrical casing 1 of the machine (FIG. 2).

The machine for sorting flat objects according to the invention functions in the following manner.

The flat objects 5 to be sorted are separated one-by-one from the mass 6 of objects by means of the separating mechanisms 9 and 10 (FIGS. 2 and 4).

The device 3 or 4 identifies a characteristic feature of each object such as zip code, using the device 11 or 12. The characteristic feature used for identification corresponds to the number of the magazine 2 to which the sorted object 5 is to be fed. After the identification, the object 5 is engaged by the branches 30 and rests on lower arms 29 of the object carrier 22 approaching the loading station (FIGS. 1, 2 and 4).

The rotary drum 13 of the squirrel cage type continuously rotates about the vertical axis of the machine inside the casing 1 (FIGS. 1 and 4).

The arm 26 mounted on the rod 23 of the drum 13 is rigidly connected to the inner cam follower portion 28 which is displaced along the channel 18 during the continuous rotation of the drum 13, and at the other end, the arm 26 supports the object carrier 22 holding the flat object 5.

The transition of the object carrier 22 to a desired level of the magazine 2 is effected by the entrance of the inner cam following portion 28 into the inclined channel 20 via the switch 21, the arm 26 moving along the rod 23 of the drum 13 (FIG. 5).

The object removing means 24 and the cams 25 for unloading the objects 5 from the magazines 2 are displaced in the similar manner.

When the object carrier 22 with the object 5 approaches the desired magazine 2, the driven stop 35 of this magazine is lifted upon the displacement of the rod 39 actuated by the driving mechanism 36 or 37 (FIGS. 2, 4, 6) (e.g. by the electromagnet) to engage an edge of the object 5 and prevent it from further movement with the arms 29 on which it rests so that the object 5 falls down into the magazine 2.

Therefore, the object carriers, which can be used in a number 5–8 times smaller than the number of magazines 2, distribute the objects 5 among the magazines 2.

After anyone of the magazines 2 is filled up, or for any other reason which requires the unloading of the magazine 2 from the objects 5, a signal for unloading of the magazine 2 is fed.

For unloading of all magazines 2 it is sufficient to have one object removing means 24 with two groups of the cams 25. After the signal is fed, the object removing means 24 with two groups of cams 25 starts moving toward the desired magazine 2 (FIG. 2). The group of the cams 25 mounted in front of the object removing means 24 cause the displacement of the container 33 of the magazine 2 in the direction behind the roller 34 (FIGS. 2 and 4) radially toward the center of the machine first with the outer cam surface of the first cam 25, then of the second and third ones, when the container 24 approaches the magazine 2 to be unloaded. When the container 33 is in the closest position to the center of the machine, the object removing means 24 engages the packs of the objects 5 and removes them from the container 33.

Then the object removing means 24 continues to move along the circumference of the respective level of the magazines 2 along the channel 18 together with the second group of the cams 25 which return the container 33 back into the magazine 2 by the outer cam surface of the first cam 25, then of the second and third cams.

The object removing means 24 continues its movement along its distributing channel 18 and is transferred at the end thereof into the inclined channel 20 and then into the closed channel 19 (FIG. 5) to move up to the delivery conveyor 43 along this channel (FIG. 2).

Linear speed of the conveyor 43 is greater than the linear speed of the object removing means 24. Accordingly, the stops 44 (FIG. 4) of the conveyor 43 withdraw the pack of the sorted objects 5 from the object removing means 24 into the conveyor 43. The conveyor 43 transfers the pack of the sorted objects from the machine for further handling, e.g. for insertion of labels and packaging in a mailbag when the machine is used for sorting letters.

As is apparent from the above description and drawings, the structure of the invention includes a rotary cage means 13 having a central, vertical axis of rotation and including upper and lower rings respectively situated in horizontal planes normal to this axis of rotation. The several vertical rods 23 of the rotary cage means extend between and are fixed to these rings, the rods 23 being parallel to the axis of the rotary cage means and uniformly distributed thereabout. An arm means 26 has a portion 27 surrounding each rod 23 so as to be guided by each rod for vertical movement therealong, each arm means 26 having an inner cam-follower portion 28 and an outer elongated portion for supporting a means such as the object-carrier means 22 or 24, or the cam means 25.

Situated within the rotary cage means, coaxially therewith, is the cylindrical cam means 14 which is stationary and which has at its outer surface camming portions, such as the circumferentially extending grooves 16 and the inclined helical grooves 20.

Any pair of circumferential grooves 16, above or below the longest circumferential groove 19, define with the pair of opposed inclined grooves 20 the configuration of a trapezoid when the cam means 14 is developed into a plane, as shown in FIG. 5. Moreover, at the junctions between the circumferential and inclined grooves there are the several switch means 21 which control the travel of the cam-follower means 28.

Each object carrier means 22 supports the flat object 5 only at its opposed ends, so that when a stop member 35 is raised to the elevation of the object 5 to a location between the opposed end thereof which rest on the arms 29, the stop means 35 will terminate the movement of the object 5 while the carrier means 22 continues to move, and thus the object 5 will no longer be supported by the object carrier means 22 and instead will simply fall into a container 33 resting on an interior raised surface portion thereof, as is apparent from FIG. 4. When the cam means 25 displaces a container 33 to be situated at the same radial distance from the axis of cage means 13 as the object-removing means 24, the latter will with its opposed arms embrace the objects 5 on the raised surface of the container 33 and will displace the objects from the container 33 which then is returned to its outer position by the cams 25. Then a projection 44 of the conveyer 43 becomes situated between the opposed arms of the carrier 24 to engage the articles or objects 5 carried thereby causing the carrier 24 to move beyond the objects which by reason of the projection 44, as shown in FIG. 4, will be caused to fall on the conveyer 43 to be conveyed thereby out of the apparatus of the invention.

What is claimed is:

1. In a sorting machine, rotary cage means having a central vertical axis of rotation, upper and lower rings respectively situated in horizontal planes normal to said axis of rotation, and a plurality of rods extending between and fixed to said rings, said rods being parallel to said axis and distributed about the latter, a plurality of arm means respectively having portions surrounding said rods to be guided thereby for vertical movement, each arm means having an outer portion extending outwardly beyond said rotary cage means for supporting a structure such as an object-carrier means, and each arm means having an inner cam-follower portion situated inwardly beyond said rotary cage means, and stationary cylindrical cam means situated coaxially within and surrounded by said rotary cage means, said cam means having an outer surface provided with camming portions which engage said inner cam-follower portions of said plurality of arm means for controlling the elevation of the plurality of arm means respectively along said rods while said cage means turns about its central axis with respect to said stationary cam means, said camming portions of said cam means including circumferential camming portions respectively situated in planes normal to said central axis and distributed therealong so as to be situated at different elevations for cooperating with said cam-follower portions to determine the elevations of said arm means while they turn with said cage means about said axis, and said cam means also having at its outer surface a pair of opposed oppositely inclined helical end camming portions which extend helically around said axis for changing the elevation of an arm means whose cam-follower portion engages one or the other of said inclined end camming portions, one of said circumferential camming portions being longer than the others and any pair of circumferential camming portions on one side of said longer circumferential camming portion defining with said end camming portions when said cam means is developed into a plane the configuration of a trapezoid, and switch means situated respectively at the junctions between said circumferential and helical camming portions for controlling the travel of said cam-follower portions along said circumferential and helical camming portions of said cam means.

2. The combination of claim 1 and wherein said longer circumferential camming portion is situated between a plurality of upper and a plurality of lower circumferential camming portions and forms when said cam means is developed into said plane the common base of a pair of opposed trapezoids which include said common base, the pair of upper and lower circumferential camming portions which are most distant from said longer circumferential camming portion and the opposed, helically inclined end camming portions.

3. The combination of claim 1 and wherein at least some of said outer portions of some of said arm means respectively carry a plurality of object-carrier means each having lower spaced arms for supporting a flat object at its end regions with the object extending between said lower arms, a stop member and means connected therewith for moving the same to and from a position situated between said lower arms of an object-carrier means as the latter turns with said cage means, so that said stop member can engage the object to prevent the latter from continuing to move with said object carrier means whereby the object can then fall into a container situated beneath the object.

4. The combination of claim 3 and wherein a plurality of said containers are provided to receive the objects, support means supporting said containers for radial movement toward and away from said axis, and cam means carried by some of said outer portions of some of said arm means for cooperating with said containers to displace the latter inwardly toward and outwardly away from said axis.

5. The combination of claim 4 and wherein additional object-carrier means are carried by the outer portions of some of said arm means for removing objects from said containers when the latter have been displaced inwardly toward said axis.

6. The combination of claim 5 and wherein a conveyor means is situated along the path of movement of objects carried by said additional object-carrier means, said conveyor means having projections for engaging objects carried by the additional object-carrier means and preventing them from continuing to move with said additional objectcarrier means so that the objects removed therefrom will fall onto said conveyer means, said conveyer means conveying the objects received thereby away from the sorting machine.

* * * * *